US010583572B2

(12) United States Patent
Herlitz

(10) Patent No.: US 10,583,572 B2
(45) Date of Patent: Mar. 10, 2020

(54) KNIFE

(71) Applicant: MARTOR KG, Solingen (DE)

(72) Inventor: Martin Herlitz, Remscheid (DE)

(73) Assignee: MARTOR KG, Solingen (DE)

( * ) Notice: Subject to any disclaimer, the term of this patent is extended or adjusted under 35 U.S.C. 154(b) by 0 days.

(21) Appl. No.: 14/907,641

(22) PCT Filed: Aug. 1, 2014

(86) PCT No.: PCT/DE2014/000395
§ 371 (c)(1),
(2) Date: Jan. 26, 2016

(87) PCT Pub. No.: WO2015/018387
PCT Pub. Date: Feb. 12, 2015

(65) Prior Publication Data

US 2016/0158945 A1 Jun. 9, 2016

(30) Foreign Application Priority Data

Aug. 9, 2013 (DE) ..... 20 2013 007 112 U

(51) Int. Cl.
*B26B 5/00* (2006.01)
*B26B 1/08* (2006.01)

(52) U.S. Cl.
CPC ..... *B26B 5/003* (2013.01); *B26B 1/08* (2013.01); *B26B 5/001* (2013.01)

(58) Field of Classification Search
CPC ..... B26B 5/001; B26B 5/003; B26B 1/08
USPC ..... 30/2, 162
See application file for complete search history.

(56) References Cited

U.S. PATENT DOCUMENTS 3,641,667 A * 2/1972 Leopoldi ..... B26B 27/005 30/161
4,683,656 A * 8/1987 Peyrot ..... B26B 5/003 30/151
4,713,885 A * 12/1987 Keklak ..... B26B 5/003 30/162
4,757,612 A * 7/1988 Peyrot ..... B26B 29/02 30/151
5,303,474 A * 4/1994 Keklak ..... B26B 5/003 30/125
5,426,855 A * 6/1995 Keklak ..... B26B 5/003 30/162
5,711,077 A * 1/1998 Schulz ..... B26B 25/005 30/160
5,890,294 A * 4/1999 Keklak ..... B26B 5/001 30/125
6,643,936 B2 * 11/2003 Carlson ..... B26B 25/005 30/162

(Continued)

*Primary Examiner* — Jason Daniel Prone
(74) *Attorney, Agent, or Firm* — Andrew Wilford

(57) ABSTRACT

A knife has a casing, a blade, and a blade support carrying the blade and movable in the casing between a rear safety position in which the blade is recessed in the casing, a cutting position in which the blade projects forward out of the casing, and a blade-change position forward of the cutting position and in which the blade projects out of the casing to a greater extent than in the cutting position. An actuator can move the blade support, and a latch is slidable into and out of a blocking position fixing the blade support in the blade-change position in a releasable manner.

7 Claims, 2 Drawing Sheets

(56) References Cited

U.S. PATENT DOCUMENTS 6,813,833 B2 * 11/2004 Saunders ..... B26B 5/003 30/125
7,322,110 B2 * 1/2008 Hernandez ..... B26B 5/003 30/162
7,784,189 B2 * 8/2010 Polei ..... B26B 5/001 30/162
8,028,420 B2 * 10/2011 Gui ..... B26B 5/001 30/162
8,056,241 B2 * 11/2011 Davis ..... B26B 5/003 30/162
8,065,803 B2 * 11/2011 Austin ..... B26B 5/001 30/151
8,122,605 B2 * 2/2012 Votolato ..... B26B 5/003 30/158
8,220,160 B2 * 7/2012 Davis ..... A45F 5/02 30/162
8,250,764 B2 * 8/2012 Davis ..... B26B 5/003 30/162
8,307,556 B2 * 11/2012 Davis ..... B26B 5/003 30/162
8,347,509 B2 * 1/2013 Votolato ..... B25F 1/003 30/156
8,353,109 B2 * 1/2013 Rohrbach ..... B26B 5/003 30/162
8,561,305 B2 * 10/2013 Davis ..... B26B 5/001 30/162
8,776,380 B1 * 7/2014 Quimby ..... B26B 5/003 30/155
8,931,180 B2 * 1/2015 Davis ..... B26B 5/003 30/162
9,808,941 B2 * 11/2017 Jacobs ..... B26B 9/00 30/155
2002/0124418 A1 * 9/2002 Votolato ..... B26B 5/00 30/294
2003/0154605 A1 * 8/2003 Chao ..... B26B 5/001 30/162
2003/0154606 A1 * 8/2003 Saunders ..... B26B 5/003 30/162
2004/0237312 A1 * 12/2004 Hernandez ..... B26B 5/003 30/162
2007/0074402 A1 * 4/2007 Hernandez ..... B26B 5/003 30/162
2007/0209209 A1 * 9/2007 Davis ..... A45F 5/02 30/162
2008/0163493 A1 * 7/2008 Votolato ..... B26B 5/003 30/154
2009/0307911 A1 * 12/2009 Austin ..... B26B 5/001 30/162
2010/0088900 A1 * 4/2010 Davis ..... B26B 5/003 30/162
2011/0119925 A1 * 5/2011 Rohrbach ..... B26B 5/003 30/158
2011/0302787 A1 * 12/2011 Rohrbach ..... B26B 5/003 30/162
2013/0014391 A1 * 1/2013 Davis ..... B26B 5/003 30/125
2013/0185943 A1 * 7/2013 Landwehr ..... B26B 29/02 30/153
2013/0239415 A1 * 9/2013 Wagner ..... B26B 1/08 30/162
2014/0366385 A1 * 12/2014 Herlitz ..... B26B 5/001 30/162
2016/0229074 A1 * 8/2016 Rohrbach ..... B26B 29/02 30/153
2016/0325442 A1 * 11/2016 Herlitz ..... B26B 5/003 30/162

* cited by examiner

KNIFE

CROSS REFERENCE TO RELATED APPLICATIONS

This application is the US-national stage of PCT application PCT/DE2014/000395 filed 1 Aug. 2014 and claiming the priority of German patent application 202013007112.5 itself filed 9 Aug. 2013.

BACKGROUND OF THE INVENTION

The invention relates to a knife having a casing in which a blade support can move. The blade support can move between a safety position, a cutting position, and a blade-change position. For example, the cutting position lies on the same path of movement between the safety position and the blade-change position. In the safety position a blade held on the blade support is recessed inside the casing so as to be inaccessible to the user and not pose a risk of injury. From the safety position the blade support can be moved into a cutting position in which the blade projects out of the casing. In the cutting position a cutting operation can be carried out.

BACKGROUND OF THE INVENTION

From the safety position the blade support can also be moved into a blade-change position in which the blade projects out of the casing to a greater extent than in the cutting position. In the blade-change position the blade can be for example partially or completely out of the casing. From the cutting position or the blade-change position the blade support can be moved back into the safety position. The knife according to the invention comprises an actuator. The blade support can be moved with the actuator. A handle is part of the actuator. The handle is operated by the user to move the blade support. Such a knife is known from the prior art.

OBJECT OF THE INVENTION

The object of the present invention addresses is to provide a knife that whose blade is easy to change and that is designed to have a high level of safety.

SUMMARY OF THE INVENTION

The knife according to the invention comprises a latch that can releasably fix the blade support in the blade-change position. The blade support can be fixed directly or indirectly. This means that the blade support may also for example be fixed by locking for example a part of the actuator and, in particular, the handle of the actuator that moves jointly with the blade support.

The latch can be moved for example between a blocking position and a unblocking position, and movement of the blade support is locked by the latch in the blocking position and such movement is allowed in the unblocking position. The movement between the blocking position and the unblocking position may be for example rotation and/or straight-line movement.

In the blocking position the latch is engaged for example directly and/or indirectly with the blade support or with the actuator. In the blocking position the latch is engaged for example directly and/or indirectly with the handle of the actuator. In the unblocking position the latch is disengaged from the blade support or from the actuator.

One embodiment is characterized in that in the cutting position the blade support or the actuator is in contact with a first stop. The first stop defines the cutting position of the blade support. The first stop can be moved for example between a limiting position and a freeing position. In the limiting position the first stop extends for example into the path of movement of the blade support or an element of the actuator in such a manner that the blade support is in contact with a rear face of the first stop when the blade support is in the cutting position. In the freeing position the first stop has been moved out of the path of movement of the blade support or the element of the actuator. With respect to the features as regards the definition of the cutting position by the stop, reference is also made to DE 10 2005 049 411 [U.S. Pat. No. 7,784,189], the disclosure of which is to be incorporated in the disclosure of the present application. The knife may comprise for example a safety device that prevents the stop, when in the cutting position of the blade support, from being adjusted to the freeing position. The safety device may for example comprise a first positive locking formation on the first stop and a second positive locking formation that is on with the blade support.

In the blade-change position the blade support or the actuator is for example in contact with a second stop. The second stop defines for example the blade-change position. The second stop is formed for example from the casing, and the handle is in contact with the second stop when in the blade-change position.

The handle can be moved for example between an unactuated position and an actuated position. In the unactuated position the blade support is in the safety position, and in the actuated position the blade support is in the cutting position. The handle can be moved for example beyond the actuated position into an end position, and in the end position the blade support is in the blade-change position.

If the first stop is in the limiting position, then the handle can be moved for example only between the unactuated position and the actuated position. In the blade-change position the blade can be for example moved partially or entirely out of the casing.

The handle is for example pivotal on the casing. In this case, the handle can pivot for example between the unactuated position, the actuated position, and the end position. According to one alternative, the handle may be displaceable between the unactuated position, the actuated position and the end position.

BRIEF DESCRIPTION OF THE DRAWING

Further advantages shall be made more readily apparent from the description of an embodiment depicted in the schematic drawings.

SPECIFIC DESCRIPTION OF THE INVENTION

Figure 1:
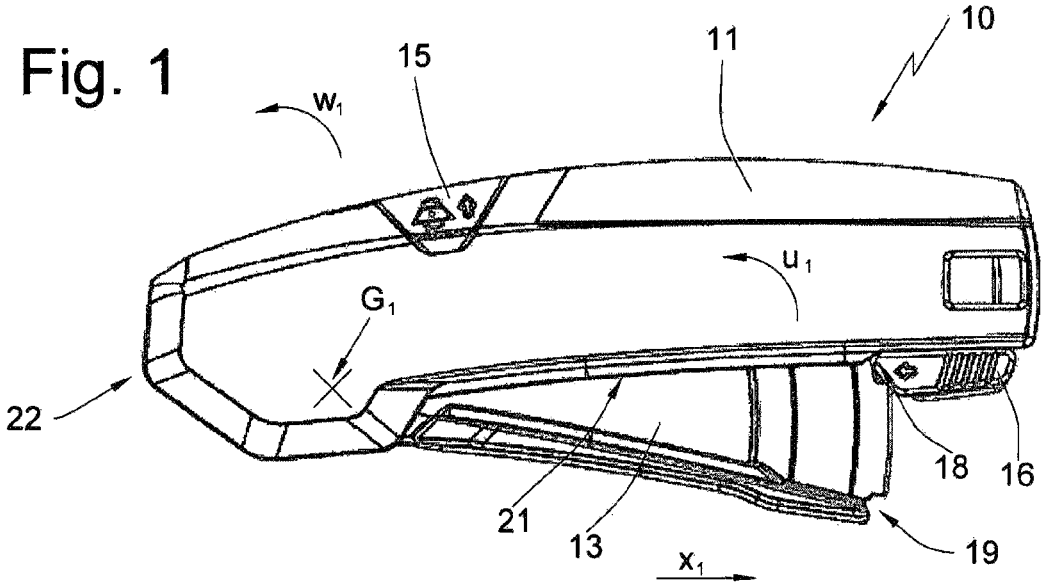
FIG. 1 is a side view of the knife with the blade support is in the safety position, the first stop in the limiting position, and the latch in the blocking position.

The reference numeral 10 in the drawings designates a knife as a whole. Like reference numerals in different figures designate the same parts, even if a small letter has been added or omitted.

Figure 6:
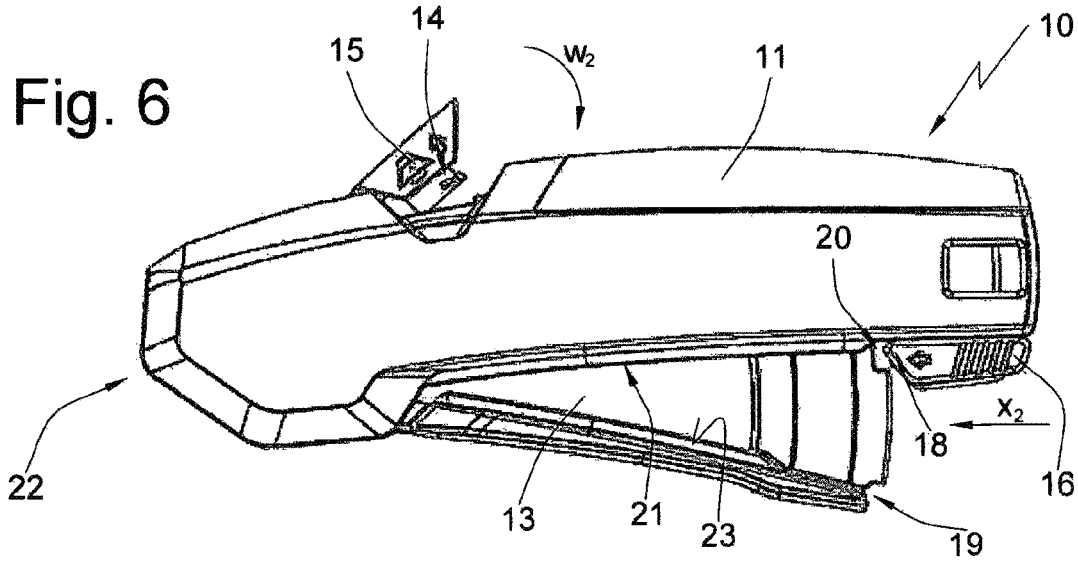
FIG. 6 shows the knife as in FIG. 5 but with the latch in the unblocking position and the handle in the unactuated position.

FIG. 1 is a side view of the knife 10. The knife 10 comprises a casing 11 in which a blade support 12 is mounted so as to be able to move between a safety position (see for example FIGS. 1, 2, and 6), a cutting position (see FIG. 3), and a blade-change position. From the safety position the blade support 12 can be moved forward in a direction $y_1$ into the cutting position and into the blade-change position. From the blade-change position and from the cutting position the blade support 12 can be moved rearward in a direction $y_2$ into the safety position.

A blade 17 is held in a known manner on the blade support 12. In the safety position the blade 17 is recessed in the casing 11, and in the cutting and blade-change positions the blade 17 projects forward out through a front opening 22 of the casing 11. In the blade-change position the blade 17 is moved further forward out of the casing 11 as compared to the cutting position. The blade support 12 is biased into the safety position by a return device (not shown). The blade support 12 can be moved by an actuator between the safety position and the cutting position.

A handle 13 is part of the actuator. The handle is carried on the casing by a pivot $G_1$, and can be pivoted thereon between an unactuated position and an end position. The actuated position is between the unactuated position and the end position of the handle 13 (see FIG. 3). From the unactuated position the handle 13 can be pivoted in an inward direction $u_1$ into the actuated position and thence into the end position. The end position is characterized in that a holding face 23 of the handle 13 abuts a stop formation 21 of the casing 11 and blocks further movement in the direction $u_1$. From the inner end position the handle 13 can be pivoted in an outward direction $u_2$ into the unactuated position. From the actuated position the handle can be pivoted outward in the direction $u_2$ into the unactuated position.

Figure 2:
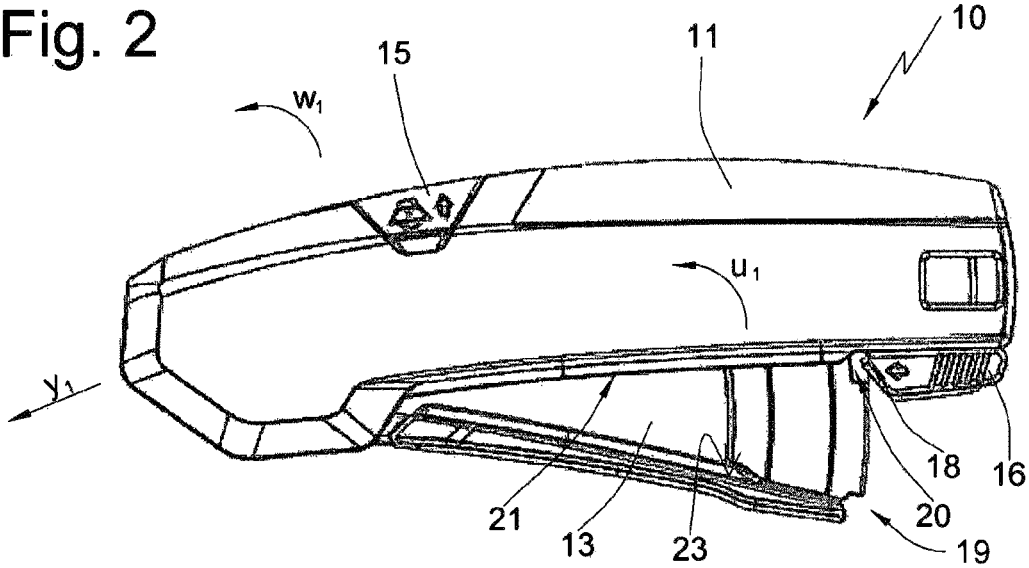
FIG. 2 shows the knife as in FIG. 1 but with the latch in the unblocking position.
Figure 3:
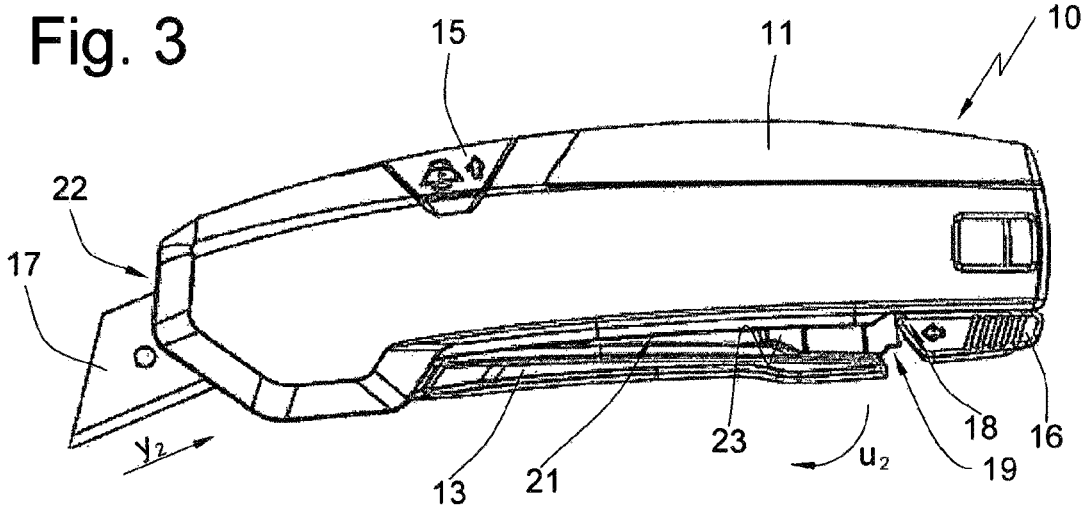
FIG. 3 shows the knife as in FIG. 2 but with the blade support in the cutting position and the handle in the actuated position.

In an unactuated position of the handle 13 illustrated in FIGS. 1 and 2, the blade support 12 is in the safety position. Pivoting the handle 13 into the actuated position according to FIG. 3 causes the blade support 12 to move into the cutting position. The handle 13 is biased into the unactuated position by a respective return device. In the cutting position the blade support 12 abuts a first face 14 that is part of a first stop 15. In the present embodiment, the first stop 15 is held on the casing 11 so as to be able to pivot in outward and inward directions $w_1$, $w_2$ between a limiting position (see FIGS. 1 to 3) and a freeing position (see FIGS. 4 to 6). According to one alternative embodiment, the latch could also be for example slidable. From the limiting position according to FIGS. 1 and 2, the first stop 15 can be moved in the direction $w_1$ into the freeing position. From the freeing position according to FIG. 6, the first stop 15 can be moved inward in the direction $w_2$ into the limiting position.

In the limiting position the stop face 14 is in the path of movement of the blade support 12. The stop face 14 therefore defines the cutting position of the blade support 12, when the first stop is in the limiting position. In the freeing position the stop face 14 has been moved out of the path of movement of the blade support 12 such that the blade support 12 can be moved beyond the cutting position into the blade-change position (see FIGS. 4 and 5) by movement of the handle into the end position. In the present embodiment, a safety device prevents the first stop 15 from being able to be moved into the freeing position if the blade support 12 is in the cutting position. In the blade-change position of the blade support 12, the first stop 15 cannot be pivoted in the direction $w_2$ into the limiting position.

A latch 16 is slidable on the casing 11 and can be moved between a blocking position (see FIGS. 1 and 2) and an unblocking position (see FIGS. 2, 3, 4, and 6). If the handle 13 is in the inner end position and the blade support 12 is in the blade-change position, the handle 13 can be locked by forward movement of the latch 16 into the blocking position. In the blocking position a projection 18 of the latch 16 engages directly with a recess 19 of the handle 13, thereby preventing pivoting of the handle 13. It is therefore possible to change the blade without needing to hold the handle in the end position against the restoring force of its return spring.

In the unactuated position of the handle 13, the latch 16 can also be moved into the blocking position. The projection 18 then engages directly with a recess 20 of the handle 13. The blade support 12 cannot be moved out of the safety position, nor can the handle 13 be moved out of the unactuated position if the latch is in the blocking position in engagement with the recess 20.

According to FIG. 1, the handle 13 is in the unactuated position, and the latch 16 is in the blocking position. The first stop is in the limiting position.

Figure 4:
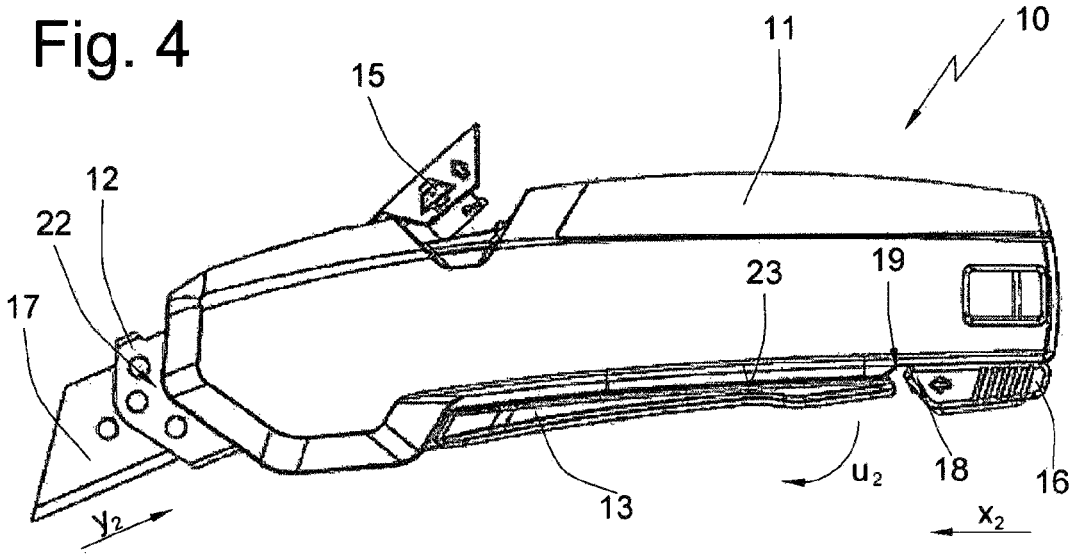
FIG. 4 shows the knife as in FIG. 2 but with the blade support in the blade-change position, the handle in the end position, and the first stop in the freeing position.
Figure 5:
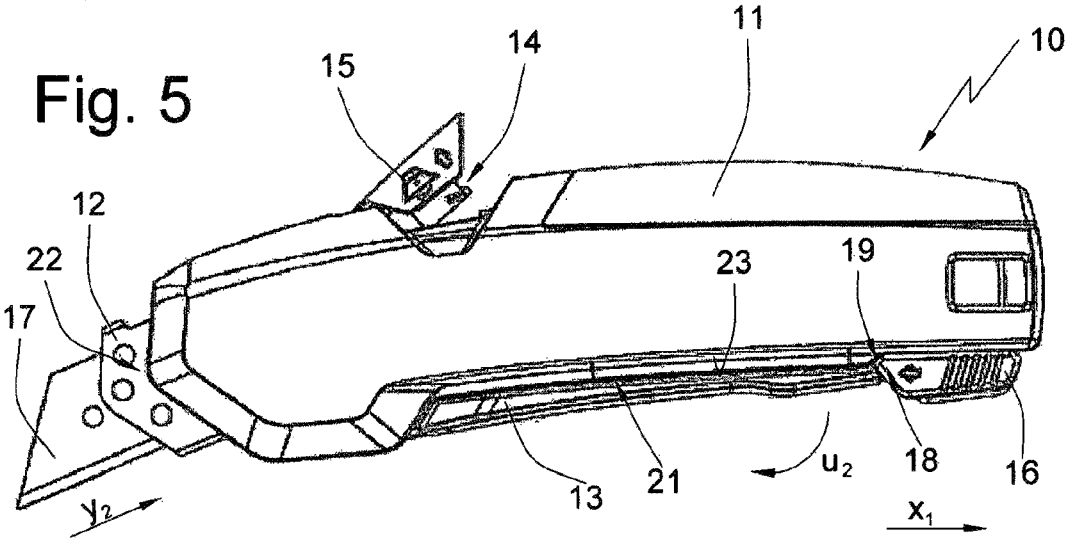
FIG. 5 shows the knife as in FIG. 4 but with the latch in the blocking position.

To prepare the knife 10 for use from the state according to FIG. 1, the latch 16 is moved in a direction $x_1$ into the unblocking position (see FIG. 2). The handle 13 can then be moved into the actuated position according to FIG. 3 in which the blade support 12 is moved in the direction $y_1$ into the cutting position and abuts against the stop face 14. In the cutting position of the blade support 12, the first stop 15 cannot be pivoted into the unblocking position. If the handle 13 is released, then the return device moves the blade support 12 in the direction $y_2$ into the safety position, and moves the handle 13 in the direction $u_2$ into the unactuated position. If the blade needs to be changed, then, starting from the position of the knife 10 according to FIGS. 1 and 2, the latch 16 must be moved in the direction $x_1$ into the unblocking position and the first stop 15 must be pivoted in the direction $w_1$ into the freeing position. The handle 13 can then be moved into the end position where the blade support 12 can be moved in the direction $y_1$ into the blade-change position. The blade-change position is shown in FIG. 4. In the end position of the handle 13 (see FIG. 4), the latch 16 is moved in the direction $x_2$ into the blocking position (see FIG. 5). The handle 13 then remains in the end position and the blade support 12 remains in the blade-change position without the user needing to actuate the handle 13 against the restoring force of the return device. It is now easy to change the blade.

In order to switch the knife from the blade-change position back into the position of FIG. 2, the latch 16 is moved in the direction $x_1$ into the unblocking position. The return device then moves the handle 13 in the direction $u_2$ into the unactuated position, and moves the blade support 12 in the direction $y_2$ into the safety position (see FIG. 6). In the safety position according to FIG. 6, the first stop 15 can be pivoted in the direction $w_2$ into the limiting position (see FIG. 2).

The invention claimed is:

1. A knife comprising:

a casing;

a blade;

a blade support carrying the blade and movable in the casing between a rear safety position in which the blade is recessed in the casing, a cutting position in which the blade projects forward out of the casing, and a blade-change position forward of the cutting position and in which the blade projects out of the casing to a greater extent than in the cutting position;

a handle movably connected to the casing and having a first formation and a second formation spaced and separate from the first formation, operatively engaging the blade support for moving the blade support between the safety, cutting, and blade-change positions, and movable relative to the casing between an unactuated position allowing the blade support to move into the rear safety position, an actuated position moving the blade support to the cutting position, and an end position moving the blade support into the blade-change position; and a latch on the casing and movable relative to the handle between an unblocking position disengaged from the first and second formations and a blocking position engaging the second formation when the handle is in the end position to retain the handle in the end position and engaging the first formation when the handle is in the unactuated position to retain the handle in the unactuated position.

2. The knife according to claim 1, further comprising:

a first stop movable connected to the casing and contacting the blade support in the cutting position.

3. The knife according to claim 2, wherein the first stop can be moved on the casing between a limiting position in which the first stop is in a path of movement of the blade support and a freeing position in which the first stop is offset from the path of movement of the blade support.

4. The knife according to claim 1, wherein the blade support is movable in the unblocking position of the latch.

5. The knife according to claim 1 wherein a face of the casing is engageable with the handle in the blade-change position.

6. The knife according to claim 1, wherein the handle is pivotal on the casing.

7. The knife according to claim 1, wherein the latch and handle are interengageable to releasably lock the handle in the safety position.

* * * * *